US009704421B2

(12) United States Patent
Takahashi

(10) Patent No.: US 9,704,421 B2
(45) Date of Patent: Jul. 11, 2017

(54) DISPLAY DEVICES

(75) Inventor: Tsuzuki Takahashi, Kaifu-gun (JP)

(73) Assignee: NICHIA CORPORATION, Anan-shi (JP)

( * ) Notice: Subject to any disclaimer, the term of this patent is extended or adjusted under 35 U.S.C. 154(b) by 1663 days.

(21) Appl. No.: 12/272,962

(22) Filed: Nov. 18, 2008

(65) Prior Publication Data

US 2009/0146921 A1 Jun. 11, 2009

(30) Foreign Application Priority Data

Dec. 11, 2007 (JP) ..... 2007-319622

(51) Int. Cl.

| | |
|---|---|
| ***G09G 3/20*** | (2006.01) |
| ***G09F 9/33*** | (2006.01) |
| ***G09F 13/22*** | (2006.01) |
| ***G09F 27/00*** | (2006.01) |

(52) U.S. Cl.

CPC ..... *G09F 9/33* (2013.01); *G09F 13/22* (2013.01); *G09F 27/008* (2013.01); *G09F 2013/222* (2013.01)

(58) Field of Classification Search

CPC ..... G09G 3/20
USPC ..... 345/82
See application file for complete search history.

(56) References Cited

U.S. PATENT DOCUMENTS

| | | | | |
|---|---|---|---|---|
| 5,836,676 | A * | 11/1998 | Ando | G09F 9/33 257/E25.02 |
| 6,330,111 | B1 * | 12/2001 | Myers | G09F 9/33 359/599 |
| 2003/0058643 | A1 | 3/2003 | Barlow et al. | |
| 2003/0231151 | A1 * | 12/2003 | Barlow | G09F 9/33 345/82 |
| 2009/0183125 | A1 * | 7/2009 | Magal et al. | 715/863 |

FOREIGN PATENT DOCUMENTS

| | | | |
|---|---|---|---|
| JP | H11-305689 | A | 11/1999 |
| JP | 2000-181363 | A | 6/2000 |
| JP | 2001-056647 | A | 2/2001 |
| JP | 2006-243418 | A | 9/2006 |
| JP | 2007-188085 | A | 7/2007 |

OTHER PUBLICATIONS

The extended European Search Report of corresponding European Application No. 08170076.7, dated Feb. 24, 2010.
Japanese Office Action of the corresponding Japanese Application No. 2007-319622, dated Jun. 5, 2012.

* cited by examiner

*Primary Examiner* — Kent Chang
*Assistant Examiner* — Sepideh Ghafari
(74) *Attorney, Agent, or Firm* — Global IP Counselors, LLP

(57) ABSTRACT

A display device in which pixels constituted by light emitting elements arranged on a substrate are arranged in a matrix, the substrate comprises: a canopy disposed at the upper or lower end of the pixels; and at least two kinds of anti-reflective components that are formed at a peripheral edge of the light emitting element and with different reflection angles with respect to incident light.

23 Claims, 5 Drawing Sheets

DISPLAY DEVICES

BACKGROUND OF THE INVENTION

1. Field of the Invention

The present invention relates to a display device, and more particularly to a display device in which a plurality of light emitting elements are arranged in a matrix.

2. Background Information

Exterior-use display devices in which a plurality of light emitting elements are arranged in a matrix and various graphics or text is displayed have been in use for some time. With such a display device, it is known that incoming light incident at the face where the light emitting elements are disposed is reflected in the display observation direction, which decreases the contrast of the display device itself.

Various approaches have been adopted to minimize this decrease in contrast. For instance, a display device has been proposed that comprises a main canopy formed above the light emitting elements, and an auxiliary canopy provided separately from this main canopy (for example, see Japanese Laid-open Patent Application No. H11-305689 and 2001-56647, etc.).

For example, the above described display device comprises a wiring board having means for driving light emitting elements, and a base or the like on which light emitting elements are arranged and fixed in a dot matrix, and the display device face comprises a main canopy for blocking incoming light from diagonally above the light emitting elements, and an auxiliary canopy located under the light emitting elements for minimizing surface reflection from the base.

With conventional display devices, however, it is not currently possible to obtain good contrast by adequately reducing the effect of sunlight or other such incoming light while ensuring a good viewing angle from below the display device.

That is, with the above-mentioned display device, if an attempt is made to ensure a good viewing angle from below the display device, the pixels and the auxiliary canopy have to be separated by a specific distance. Consequently, this increases the region between the pixels and the auxiliary canopy where incident light from the outside can be reflected in the display observation direction, and this leads to a decrease in contrast. Furthermore, no method has been found for adequately reducing the reflection of incoming light between the auxiliary canopy and the main canopy.

SUMMARY OF THE INVENTION

The present invention was conceived in light of the above problems, and it is an object thereof to provide display device in which viewing angle from below the display device is ensured while light reflected in the emission observation direction is kept to a minimum and contrast is adequately increased.

The present invention provides a display device in which pixels constituted by light emitting elements arranged on a substrate are arranged in a matrix, the substrate comprising: a canopy disposed at the upper or lower end of the pixels; and at least two kinds of anti-reflective components that are formed at a peripheral edge of the light emitting element and with different reflection angles with respect to incident light.

With the present invention, light coming in from diagonally above the light emitting elements can be effectively blocked by a canopy, and reflection at the display face of a display device with which incoming light is incident from a relatively low angle, that is, reflection at the display face on the upper side within a unit pixel, can be efficiently suppressed by at least two kinds of anti-reflective component with different reflection angles with respect to incident light. This allows a good viewing angle from below the display device to be ensured while light reflected in the emission observation direction is kept to a minimum and contrast is adequately increased.

DETAILED DESCRIPTION OF THE PREFERRED EMBODIMENTS

The best mode for carrying out the invention will now be described through reference to the drawings, but the mode described below merely exemplifies a display device for embodying the technological concepts of the present invention, and the present invention is not limited to the display device discussed below. Also, this Specification does not limit the members given in the Claims to the members of the embodiments. The sizes, materials, shapes, relative disposition, and so forth of the constituent members discussed in the embodiments are not unless, otherwise specified, intended to limit the scope of the invention to just those, and are merely given as descriptive examples. Furthermore, the size, positional relationships, and so forth of the members illustrated in the various diagrams may be exaggerated in order to make the description more clear. Also, in the following description, members that are the same or have the same properties are given the same names and numbers, and their detailed description may be omitted as appropriate. Furthermore, the various elements that make up the display device of the present invention may be in a mode such that a plurality of elements are constituted by the same member, and a plurality of elements all serve as a single member, or conversely, the function of a single member may be allocated to a plurality of members.

Figure 1:
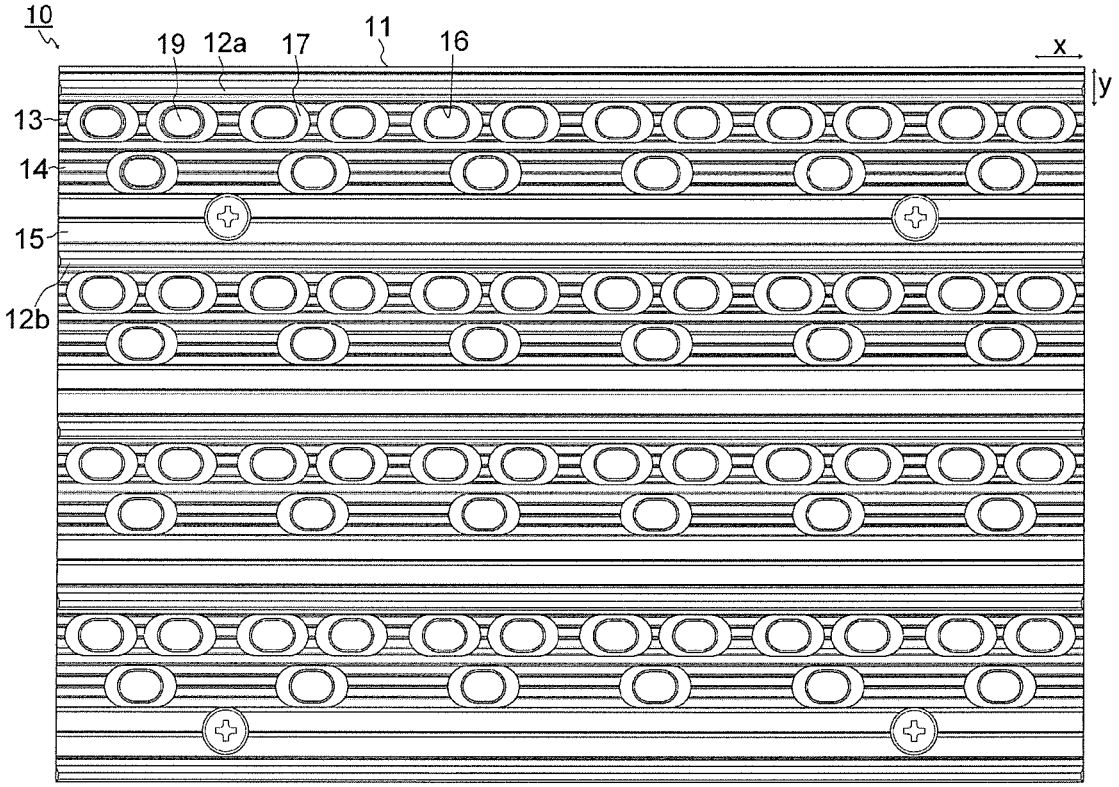
FIG. 1 is a front view of a display device according to the present invention.

As shown in FIG. 1, for example, a display device of the present invention is mainly constituted by a substrate 11 and light emitting elements arranged on the substrate 11.

The role of the substrate 11 is to allow light emitting elements 19 to be disposed, fixed, etc., in a matrix in pixel units. The substrate 11 comprises canopies 12*a* and 12*b* disposed at the upper end and/or lower end of the pixels in order to suppress the direct irradiation of the light emitting elements with sunlight or other such incoming light, and at least two kinds of anti-reflective components that are formed at a peripheral edge of the light emitting element and with different reflection angles with respect to incident light. A canopy is to be present at least at the upper end of one unit of the repeating structure discussed below, and if a canopy is also present at the lower end, is may also serve as the upper end canopy for the adjacent row below. As shown in FIG. 1, when the canopy 12*a*, a first anti-reflective component 13, a second anti-reflective component 14, a light blocking component 15, a canopy 12*b*, and so forth are arranged in that order starting at the top (that is, in the y direction in FIG. 1), the upper end of the pixels refers to the region in which the canopy 12*a* adjacent to the first anti-reflective component 13 is disposed in a single unit of the repeating structure (the canopy 12*a*, the first anti-reflective component 13, the second anti-reflective component 14, and the light blocking component 15).

The canopies 12*a* and 12*b* can be attached to the upper end and/or lower end of the pixels, either perpendicular to the surface of the substrate 11 or slanted to the perpendicular (such as a slant of about ±10° in the up and down direction, and preferably within 10° in the downward direction), according to the place where the display device is to be installed. Also, if a plurality of pixels are arranged in columns and rows in the display device, the canopies 12*a* and 12*b* are disposed continuously, going straight in the left and right direction (that is, the x direction in FIG. 1), at the upper and lower ends of the pixels.

There are no particular restrictions on the size and shape of the canopies 12*a* and 12*b* as long as they function to effectively block incoming light from diagonally above the light emitting elements, and their size and shape can be suitably adjusted according to the size (pitch) of the pixels, the performance to be obtained for the display device, the intended application, the installation location, and so forth. For example, in the case of a display device to be used outdoors, the pitch of the pixels is preferably about 10 mm, about 12 mm, about 15 mm, about 16 mm, about 20 mm, about 25 mm, about 30 mm and the like, the height (the height in the direction of H in FIG. 2B, the same meaning below) is preferably about 3.0 mm to about 16.0 mm. The canopies 12*a* and 12*b* may also have mutually different heights.

Also, the canopies 12*a* and 12*b* may be formed integrally with, and from the same material as, the substrate 11, along with the anti-reflective components and/or the light blocking components, or may be formed separately and combined with the substrate 11.

The anti-reflective components 13 and 14 are formed at the peripheral edges of the light emitting elements 19, and usually, when pixels are arranged in a plurality of rows and columns in a display device, these anti-reflective components 13 and 14 are disposed continuously, going straight in the left and right direction, just as with the above-mentioned canopies 12*a* and 12*b*, and are disposed parallel to the canopies 12*a* and 12*b*.

At least two kinds (that is, three kinds, four kinds, or five or more kinds) of the anti-reflective components can be formed so that they have different reflection angles with respect to incident light, but two kinds are preferable when we take into account the complexity of the manufacturing process, the effect of suppressing undesired reflection to the display observer, and so forth.

The two or more kinds of anti-reflective components may be suitably distributed within a unit pixel, but as shown in FIG. 1, for example, a plurality may be disposed parallel to each other in the up and down direction (that is, in the y direction in FIG. 1), and may be disposed so as to have different reflection angles with respect to incident light on row-to-row. For example, if there are two kinds of anti-reflective components with different reflection angles with respect to incident light, it is preferable if a plurality of upper rows and a plurality of lower rows are disposed so as to have different reflection angles. The result is that the reflection of light from the display face can be distributed up or down according to the movement of incoming light (sunlight) whose incidence angle to the display device varies, so reflected light traveling in the line of sight of the display observer can be further reduced.

Figure 4:
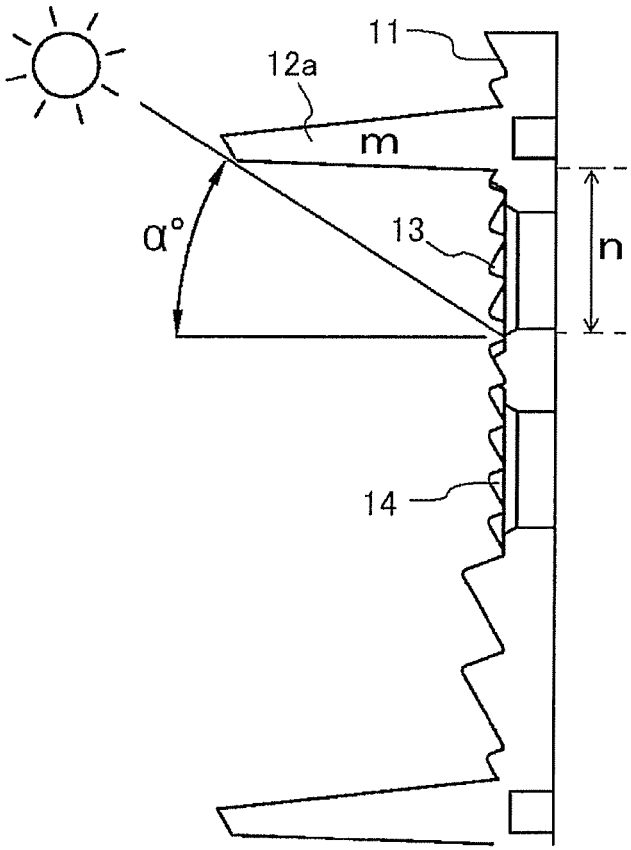
FIG. 4 is a cross-sectional view of a main portion of a display device according to the present invention describing the formation region of the first anti-reflective component.

For instance, if two kinds of anti-reflective components are formed having different reflection angles with respect to incident light, usually there will be a first anti-reflective component 13 disposed on the side near the upper end canopy 12*a*, that is, on the upper side, and a second anti-reflective component 14 disposed on the far side, that is, on the lower side. There are no particular restrictions on the region in which the first anti-reflective component 13 is formed, which can be suitably adjusted after taking into account the height of the upper end canopy 12*a*, the incidence angle to the display device of incoming light that produces the reflected light to be suppressed, and so forth. For example, as shown in FIG. 4, if m be the height of the upper end canopy 12*a*, and $\alpha°$ be the incidence angle to the display face of the display device of incoming light that produces the reflected light to be suppressed, then the length n of the region in which the first anti-reflective component is formed from the upper end canopy 12*a* (that is, the length in the up and down direction of the region in which the first anti-reflective component is formed) can be found as $m \cdot \tan\alpha°$. The angle a here can be suitably adjusted depending on the angle of inclination of first and second slanted faces forming the first anti-reflective component 13 (disposed on the upper side) and the second anti-reflective component 14 (disposed on the lower side), and on the position of the display observer, but a relatively small value is favorable. For example, taking into account such factors as the relationship between sunlight and the location where the display device is installed, an angle no greater than 45°, no greater than 35°, no greater than 30°, no greater than 25° or no greater than 20° is preferable.

Figure 2A:
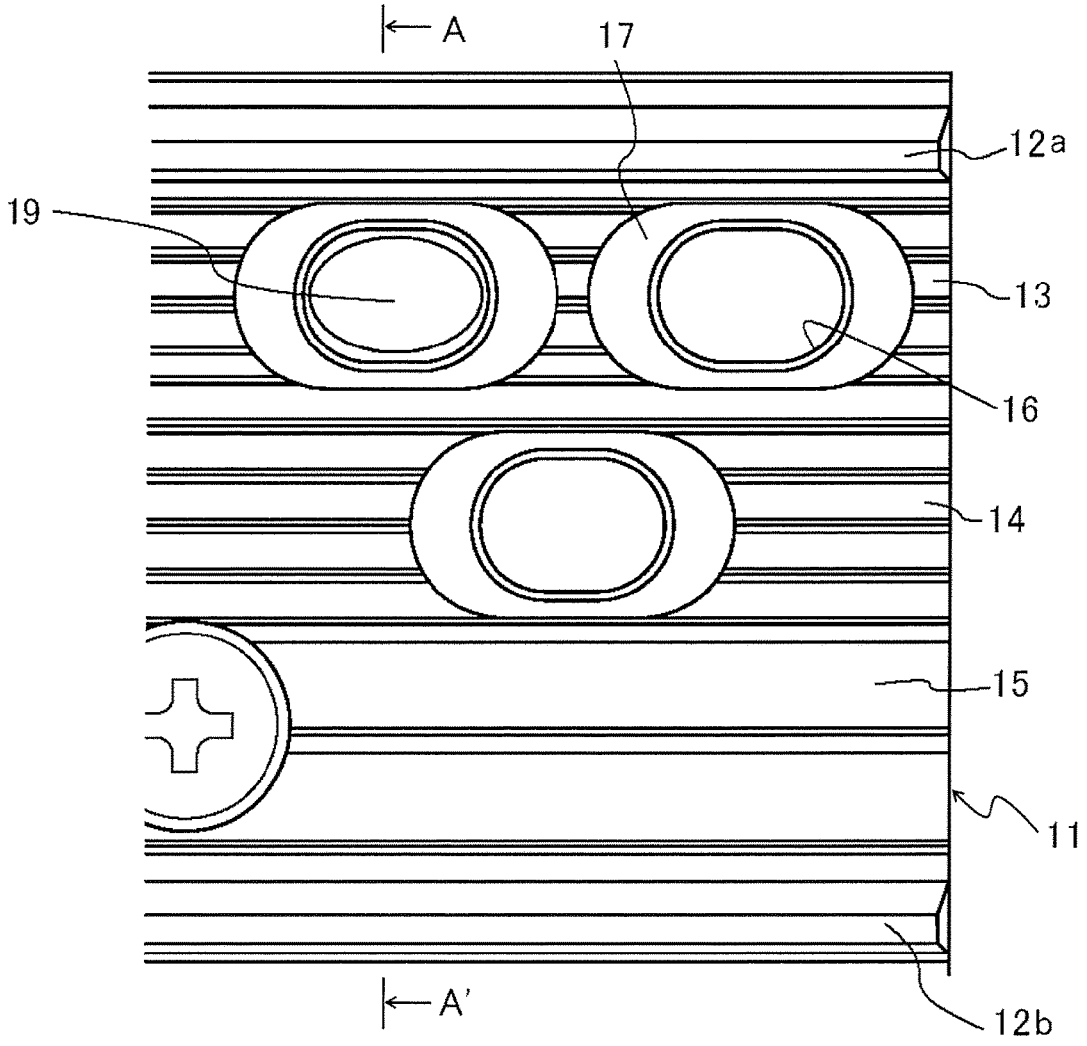
FIG. 2A is a detail front view of a main portion of FIG. 1.
Figure 2B:
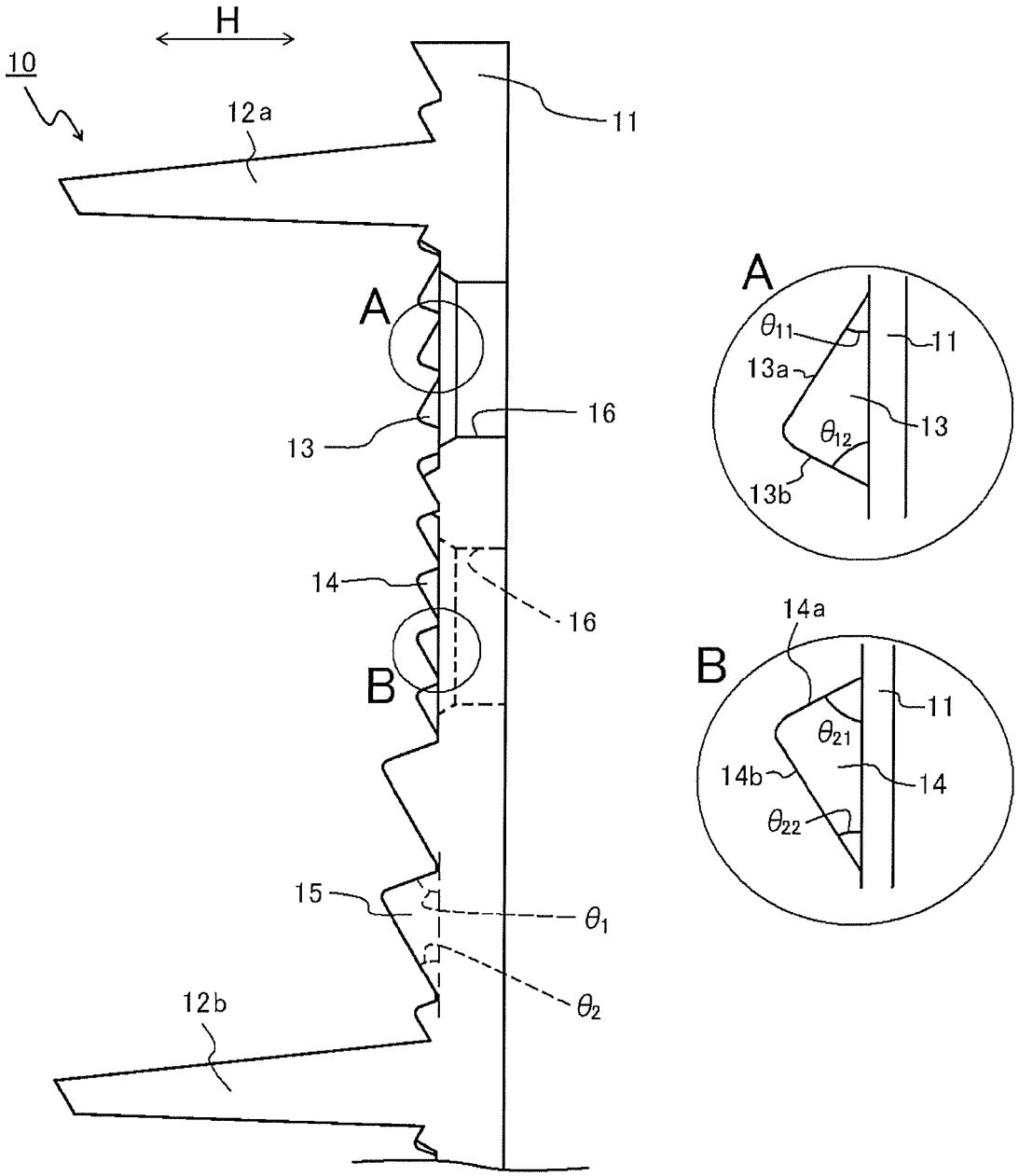
FIG. 2B is a cross-sectional view along the A-A' line of FIG. 2A.

As shown inside the circle A in FIG. 2B, the first anti-reflective component 13 favorably comprises a first slanted face 13*a* disposed on the side near the upper end canopy 12*a* (that is, the upper side), and a second slanted face 13*b* disposed on the far side (that is, the lower side). The first and second slanted faces 13*a* and 13*b* may be slanted faces having the same angle of inclination, but if we take into account the position of the display observer with respect to the display device, and the minimum amount of reflected light traveling in the line of sight of the display observer, they are preferably slanted faces with different angles of inclination.

In particular, the angle of inclination ($\theta_{11}$) of the first slanted face 13*a* with respect to the surface of the substrate 11 is preferably less than the angle of inclination ($\theta_{12}$) of the second slanted face 13*b* with respect to the surface of the substrate 11. Examples of the ranges of $\theta_{11}$ and $\theta_{12}$ are $25° \leq \theta_{11} \leq 45°$ and $65° \leq \theta_{12} \leq 85°$, respectively.

As shown inside the circle B in FIG. 2B, the second anti-reflective component 14 favorably comprises a first slanted face 14*a* disposed on the side near the upper end canopy 12*a* (that is, the upper side), and a second slanted face 14*b* disposed on the far side (that is, the lower side). The first and second slanted faces 14*a* and 14*b* may be slanted faces having the same angle of inclination, but if it takes into account the position of the display observer with respect to the display device, and the minimum amount of reflected light traveling in the line of sight of the display observer, they are preferably slanted faces with different angles of inclination.

In particular, the angle of inclination ($\theta_{21}$) of the first slanted face 14*a* with respect to the surface of the substrate 11 is greater than the angle of inclination ($\theta_{22}$) of the second slanted face 14*b* with respect to the surface of the substrate 11. Examples of the ranges of $\theta_{21}$ and $\theta_{22}$ are $65° \leq \theta_{21} \leq 85°$ and $25° \leq \theta_{22} \leq 45°$, respectively.

The angles of inclination $\theta_{11}$, $\theta_{22}$, $\theta_{12}$, and $\theta_{21}$ of the slanted faces of the anti-reflective components 13 and 14 with respect the surface of the substrate 11 may all be the same, or may be different from each other, or some may be the same and some different, but it is particularly favorable if $\theta_{11}$ and $\theta_{22}$ are the same and/or $\theta_{12}$ and $\theta_{21}$ are the same. The result of this is that the manufacturing process will be simpler, while the obtained anti-reflection effect can be maximized.

The shape of the anti-reflective components 13 and 14 in the present invention need not be one that is triangular in cross section and constituted by first and second slanted faces. For example, the boundary portion between the first slanted face and the second slanted face (the distal end or corner portion) may have a specific curvature, and the first slanted face and/or the second slanted face may be a curved face. Also, the anti-reflective components 13 and 14 are favorably all the same height, but may be different from one another, or may all be individually different.

The substrate 11 preferably further comprises a light blocking component 15. Providing the light blocking component 15 allows reflection of incoming light to be reduced at the display observation face of the display device to be reduced regardless of the pitch of the pixels.

The light blocking component 15 is preferably formed on the lower side of the light emitting elements and the lower end side in a single unit of the repeating structure. In other words, it is preferably formed on the lower side of the above-mentioned anti-reflective components 13 and 14. There are no particular restrictions on the size or shape of the light blocking component 15, but for example, it preferably has the first slanted face and second slanted face described for the anti-reflective components 13 and 14, and the height thereof is preferably shorter than that of the canopies 12*a* and 12*b* and taller than that of the anti-reflective components 13 and 14. This allows any incoming light reflected by the second slanted face to be reflected by the canopy at the adjacent pixels disposed below, so this light will not be observed in the display observation direction, and a good viewing angle from under the display device can also be ensured, and the resulting display device will have high contrast. More specifically, the difference between the height of the canopy and the height of the light blocking component is preferably about 5 to 10 mm, about 5.9 to 7.2 mm or about 8.0 to 8.6 mm.

The angles of inclination of the first and second slanted faces ($\theta_1$ and $\theta_2$, respectively) with respect to the substrate surface can be within the same ranges of angle as given above for $\theta_{11}$, $\theta_{22}$, $\theta_{12}$, and $\theta_{21}$, respectively, but they preferably satisfy $\theta_1 > \theta_2$, and more specifically, when $\theta_1$ is about 60 to 65°, $\theta_2$ is preferably about 40 to 53°, further, when $\theta_1$ is about 70 to 75°, $\theta_2$ is preferably about 27 to 32°. This will efficiently reduce the reflection of incoming light in the emission observation direction at the surface of the light blocking component and the face where the light emitting elements are disposed, affording a display device with high contrast.

Also, the substrate 11 preferably has a track-shaped flat portion 17 around the light emitting elements. The phrase "around the light emitting elements" as used here means the outer peripheral portion substantially adjacent to the light emitting elements, and the outer peripheral portion preferably has a track shape that is about 5 to 60% the width, or about 5 to 30% the width of the longest diameter of the light emitting elements as seen from the display side of the display device, for example. The "flat portion 17" refers to a state of being free of the bumps that constitute the above canopy, the light blocking component and the anti-reflective component, but encompasses a state in which the reflection of incoming light can be suppressed by fine texturing as will be discussed below. The effect of disposing this flat portion 17 around the light emitting elements is that the anti-reflective components protruding from the emission face do not narrow the viewing angle in the left and right direction (the x direction in FIG. 1), and a good viewing angle in the left and right direction can thus be ensured.

The substrate 11 can be formed from a plastic (polycarbonate resin, ABS resin, epoxy resin, phenol resin, etc.), a glass, a ceramics, a metal (simplex of aluminum, cupper, etc. and an alloy of metals thereof including Mg, Si, Fe, Cu, Mn, Cr, Zn, Ni, Ti, Pb, Sn, etc.) or the like, or from a material that combines these materials, but a plastic, and especially a polycarbonate containing glass fibers, is preferable because weatherproofness and mechanical strength can be improved relatively easily. Also, it is a relatively simple matter to color the substrate itself to black or another dark color by adding a colorant.

At least the display face of the display device substrate has fine texturing on its surface. This fine texturing reduces the gloss of the overall surface of the substrate, scatters incoming light, and minimizes the decrease in contrast that occurs when incoming light is reflected directly to the viewer side. This fine texturing can be obtained by delustering, pore formation, or other such machining or processing. For example, it can be obtained by sandblasting the surface of the substrate, coating it with a paint containing microscopic filler particles (such as silicon oxide), using a porous ceramic, etc., or another such method.

This fine texturing preferably has an average roughness (Ra) between 1 and 50 μm, preferably between 2 and 10 μm as calculated under the conditions set forth in JIS B 0601, at a roughness curve cut-off value (λc) of 0.8 mm and a roughness curve reference length of 2.40 mm. The ten-point average roughness (Rz) is preferably between 5 and 100 μm, and more preferably between 10 and 50 μm.

A single unit of pixels constituted by the light emitting elements arranged on the substrate may be constituted by one light emitting element, that is, a light emitting element of a single color, but usually in the case of a color display, it is preferably constituted by three or more light emitting elements, namely, red (R), blue (B), and green (G). The number of light emitting elements can be suitably adjusted according to the brightness of the elements required in the display device. For instance, one pixel is constituted by arranging one light emitting element that emits red light, one light emitting element that emits green light, and one light emitting element that emits blue light. Alternatively, a single pixel may be constituted by arranging one light emitting element that emits red light, two light emitting elements that emit green light, and one light emitting element that emits blue light. The pattern in which the light emitting elements are laid out within the pixel can be suitably selected by taking display quality into account. For example, with the display device shown in FIG. 1, red and green light emitting elements are disposed one on the right and one on the left on the canopy 12*a* side, while a blue light emitting element is disposed underneath, that is, on the canopy 12*b* side, thereby constituting a single pixel in the shape of an inverted triangle. When a single pixel is constituted by four light emitting elements (not shown), for example, red and green light emitting elements may be disposed one on the right and one on the left on the canopy 12*a* side, while green and blue light emitting elements are disposed underneath, that is, one on the right and one on the left on the canopy 12*b* side, thereby constituting a single pixel in the shape of a square, with two rows and two columns. Furthermore, with the display device in FIG. 1, pixels are disposed in a matrix of four rows and six columns on the substrate.

A variety of light emitting elements, such as LED chips and laser diodes (LD) can be utilized as the light emitting elements. An example of light emitting elements that can be used favorably is one in which semiconductor light emitting elements are disposed on lead electrodes in a package, etc., are electrically connected with lead electrodes, and then are covered with a resin or other such translucent member.

An LED chip, which can be used favorably as a semiconductor light emitting element, may be a single type that emits light in a single color, or a plurality may be used to emit light in one or more colors. For example, it is preferably the elements in which a light emitting layer is formed of a semiconductor such as ZnS, SiC, GaN, GaP, InN, AlN, ZnSe, GaAsP, GaAlAs, InGaN, GaAlN, AlInGaP, AlInGaN, etc, on the substrate by liquid phase growth method, HDVPE method, MOCVD method, and the like. The emission wavelength can be variously selected, from ultraviolet light to infrared light, depending on the material of the semiconductor layer, the degree of crystal mixing, and so forth. In particular, when the display device is to be one that can be used favorably outdoors, light emitting elements capable of emitting very bright light are needed. In view of this, a gallium nitride compound semiconductor is preferably selected as the material of light emitting elements that emit bright light in blue and green. A semiconductor based on gallium-aluminum-arsenic or a semiconductor based on aluminum-indium-gallium-phosphorus is preferably selected as the material of light emitting elements that emit light in red. The light emitting elements can also comprise a combination of a nitrogen compound semiconductor with phosphorescent materials that are excited by the emission wavelength of this semiconductor and that emit light in various colors.

For a color display device, it is preferably a combination of LED chips which are chips having a 610 to 700 nm of red light emitting wavelength, a 495 to 565 nm of green light emitting wavelength, and a 430 to 490 nm of blue light emitting wavelength, respectively.

Also, forming the resin or other such translucent member in the desired shape can provide a lens effect that focuses or diffuses light emitted from the light emitting elements. More specifically, examples include an oval shape, convex lens shape, or concave lens shape for widening the viewing angle in the horizontal direction, and shapes that combine a plurality of these. Furthermore, the package can contain a coloring pigment, coloring dye, or the like, and thereby provide the function of a filter that cuts out undesired wavelengths.

Through-holes corresponding to the diameter of the packaged light emitting elements are made in the substrate 11, and the emission faces of the light emitting elements are exposed through these holes on the surface side of the substrate 11. Also, the substrate is preferably provided with a mounting board that is electrically and/or mechanically connected with the light emitting elements on the opposite side from the side on which the light emitting elements are fixed (the display observation face side), means for driving the light emitting elements, a case for fixing and protecting the mounting board and/or a circuit board from the external environment, and so forth.

For example, the mounting board has light emitting elements arranged and fixed thereon, and has conductor wiring for supplying electrical power to these light emitting elements. The lead electrodes of the light emitting elements are electrically and mechanically connected to the mounting board by solder or another such electroconductive member. The mounting board on which the light emitting elements are disposed is a member on which the light emitting elements are disposed in the desired shape, and is used for electrically connecting to a conductive pattern such as copper foil provided to a substrate board, and also serves as a substrate board on which a drive means is disposed. The substrate board is preferably one with high mechanical strength and one that undergoes little thermal deformation. More specifically, a printed substrate made with ceramic, glass, an aluminum alloy, or the like can be used to advantage. Of the substrate board surface, the surface on the side on which the light emitting elements are mounted may be disposed on the display face side of the display device, and exposed from part of the substrate, so it is preferably colored black to improve contrast. The substrate board surface has preferably undergone texturing or graining, as this improves adhesion to the substrate, etc.

The drive means has a drive circuit for applying voltage to the light emitting elements, etc., and is used to control the lighting of the light emitting elements. Further, the drive means is electrically connected with the mounting board on which the light emitting elements are arranged and fixed.

More specifically, with a dynamically driven display device, the light emitting elements laid out in a matrix are driven by output pulses from the driven means. A drive circuit such as this can be constituted by a storage means for temporarily storing inputted display data, a gradation control circuit for computing a gradation signal for lighting the light emitting elements at specific times based on the data stored in the storage means, and a driver that is switched by output signals from the gradation control circuit and thereby lights the light emitting elements. For instance, the light emitting elements are lighted when the driver is on, and extinguished when the driver is off. The desired video data or the like can be displayed by controlling how long the various light emitting elements are lit. Also, display data can be inputted to the drive circuit by a central processing unit or the like.

The case is used to mechanically protect the light emitting elements arranged in a matrix on the wiring board, the substrate board on which the drive circuit is disposed, and the like from the outside. The specific material of the case is preferably a polycarbonate resin, ABS resin, epoxy resin, phenol resin, or the like because they are easier to mold. The internal surface of the case is preferably textured or subjected to a plasma treatment.

When a case is used, it holds in its interior the substrate on which the light emitting elements are arranged and fixed, the substrate on which the drive circuit is provided, and so forth, and is usually covered with a filler material. The filler material, for example, covers the lead electrodes exposed from the sealing member of the light emitting elements or the substrate on which the light emitting elements are fixed, and preferably has good adhesion with the light emitting elements, the case, the wiring board on which the light emitting elements are disposed, the substrate, and so forth. Specific examples of the filler material include one or more types selected from among epoxy resins, urethane resins, and silicone resins. To improve contrast, these resins may contain a black or other dark-colored dye or pigment. Furthermore, a thermal conduction member may be contained for the purpose of improve thermal conductivity. This thermal conduction member is preferably one that is not electrically conductive, because it is disposed between the light emitting elements. Specific examples include copper oxide and silver oxide.

Examples of the display device of the present invention will now be described through reference to the drawings.

FIG. 1 is a front view of the display device 10 in this example. FIG. 2A is a detail front view of the display device, and FIG. 2B is a cross section along the A-A' line in FIG. 2A.

This display device 10 comprises a mounting board (not shown) that is electrically and mechanically connected to the light emitting elements, a circuit board (not shown) having a drive circuit that is a means for driving the light emitting elements, a case (not shown) for protecting the mounting board and the circuit board from the external environment, a substrate 11, and light emitting elements 19.

As shown in FIG. 2A, the substrate 11 has through-holes 16 for exposing the light emitting elements 19 on the display face side, and canopies 12*a*, 12*b*, . . . , a first anti-reflective component 13, a second anti-reflective component 14, and a light blocking component 15 are integrally disposed. The entire display face of the substrate 11, including the canopies 12*a* and 12*b*, the first anti-reflective component 13, the second anti-reflective component 14, and the light blocking component 15, is finely textured by delustering. A track-shaped flat portion 17 is provided around the outer periphery of the light emitting elements 19, in a width of 0.5 to 2.0 mm, and while this part is finely textured, it is free of relatively large bumps such as the canopies 12*a* and 12*b*, the first anti-reflective component 13, the second anti-reflective component 14, and the light blocking component 15.

The substrate 11 is attached, along with the light emitting elements 19 disposed on the mounting board, to a case (not shown) formed from polycarbonate containing glass fibers. The inside of the case is filled with silicone rubber so that part of the mounting board and the lead frame portion of the light emitting elements will be covered, except for the distal ends of the light emitting elements 19. The light emitting elements are electrically connected to the drive circuit.

A structure unit in the display device 10 consists of the substrate 11, which comprises the upper end canopy 12*a*, the lower end canopy 12*b*, the first anti-reflective component 13, the second anti-reflective component 14, and the light blocking component 15, and pixels of the light emitting elements 19 arranged in groups of three through the through-holes 16 on the substrate 11. The pitch of the pixels is set to 25 mm, for example.

The canopies 12*a* and 12*b* are disposed at the upper and lower ends of the pixels so as to extend in the left and right direction (the x direction in FIG. 1) of these pixels arranged in a matrix. The pitch of the canopies 12*a* and 12*b* is 25 mm and their height is 10.6 mm, for example.

Two kinds of anti-reflective components are formed: the first anti-reflective component 13, which is disposed on the side nearer the upper end canopy 12*a*, and the second anti-reflective component 14, which is disposed on the side farther away. At least one of each of these anti-reflective components 13 and 14, such as 3.5 and 5 of them, respectively, are disposed extending in the left and right direction of the pixels arranged in a matrix. The pitch of the anti-reflective components 13 and 14 is 1.6 mm and their height is 0.6 mm, for example.

The first anti-reflective component 13 comprises a first slanted face 13*a* disposed on the side near the canopy 12*a* at the upper end of the pixels, and a second slanted face 13*b* disposed on the side farther away, so that the first anti-reflective component 13 has a triangular cross sectional shape with an apex angle of 80°.

Also, the angle of inclination ($\theta_{11}$) of the first slanted face 13*a* of the first anti-reflective component 13 with respect to the surface of the substrate 11 is set to about 30°, while the angle of inclination ($\theta_{12}$) of the second slanted face 13*b* with respect to the surface of the substrate 11 is set to 70°.

Even when the display observer is looking up at the display device from below, and when sunlight is shining on the surface of the display device at an angle of less than 90°, which is assumed as the most common scenario when sunlight shines on a display device, the first anti-reflective component 13 will allow the light to be reflected to the canopy 12*a* on the upper end side. Therefore, the light will not be reflected to the side of the display observer, who is looking up at the display device from below, and contrast can be improved.

The second anti-reflective component 14 comprises a first slanted face 14*a* disposed on the side near the canopy 12*a* at the upper end of the pixels, and a second slanted face 14*b* disposed on the side farther away, so that the second anti-reflective component 14 has a triangular cross sectional shape with an apex angle of 80°.

Also, the angle of inclination ($\theta_{21}$) of the first slanted face 14*a* of the second anti-reflective component 14 with respect to the surface of the substrate 11 is set to about 70°, while the angle of inclination ($\theta_{22}$) of the second slanted face 14*b* with respect to the surface of the substrate 11 is set to 30°.

Even when the display observer is looking up at the display device from below, and when sunlight is shining on the surface of the display device at an angle of less than 90°, which is assumed as the most common scenario when sunlight shines on a display device, the second anti-reflective component 14 will allow the light to be reflected to the canopy 12*b* on the lower end side. The range of the region in which the second anti-reflective component 14 is disposed is adjusted so that this reflected light will be blocked by the canopy 12*b*. Therefore, the light will not be reflected to the side of the display observer, who is looking up at the display device from below, and contrast can be improved.

The light blocking component 15 is disposed between the upper end canopy 12*a* and the lower end canopy 12*b*, extends in the same x direction as the canopies 12*a* and 12*b*, and is disposed under the pixels. The light blocking component 15 has a first slanted face near (facing) the upper end canopy 12*a*, and a second slanted face near (facing) the lower end canopy 12*b*, so that it has a triangular cross sectional shape with an apex angle of 78°. The result is that incoming light incident on these slanted faces can be reflected in a direction other than the display observation direction, so contrast can be further enhanced.

For example, the angles of inclination ($\theta_1$ and $\theta_2$ in FIG. 2B) of the first and second slanted faces with respect to the surface of the substrate 11 are set to 70° and 32°, respectively. The pitch between light blocking components 15 is 3.6 mm, and their height is 1.5 mm, for example.

Three LED chips capable of emitting green, blue, and red light are used as the light emitting elements. These LED chips have a semiconductor as the light emitting layer of InGaN (525 nm of wavelength), InGaN (470 nm of wavelength), AlGaInP (660 nm of wavelength), respectively. Each LED chip is die-bonded to a lead frame with silver paste, then wire bonded with gold wire, so that the LED chips and the lead frame are electrically connected. This product is then covered with an epoxy resin, forming a sealed member that is substantially oval in shape when viewed from the top of the sealed member. These LED chips are made into sealed members with an oval cross section, and are arranged so that the major axis direction of this oval is the horizontal direction of the display device. The light emitting elements are disposed such that they are inclined by about 6° downward with respect to a perpendicular of the surface of the substrate 11.

The display device in this example is usually attached so that the up and down direction in FIG. 1 (the y direction) substantially coincides with the vertical direction, the horizontal direction coincides with the x direction, and the bottom of the display device faces the ground.

Figure 3:
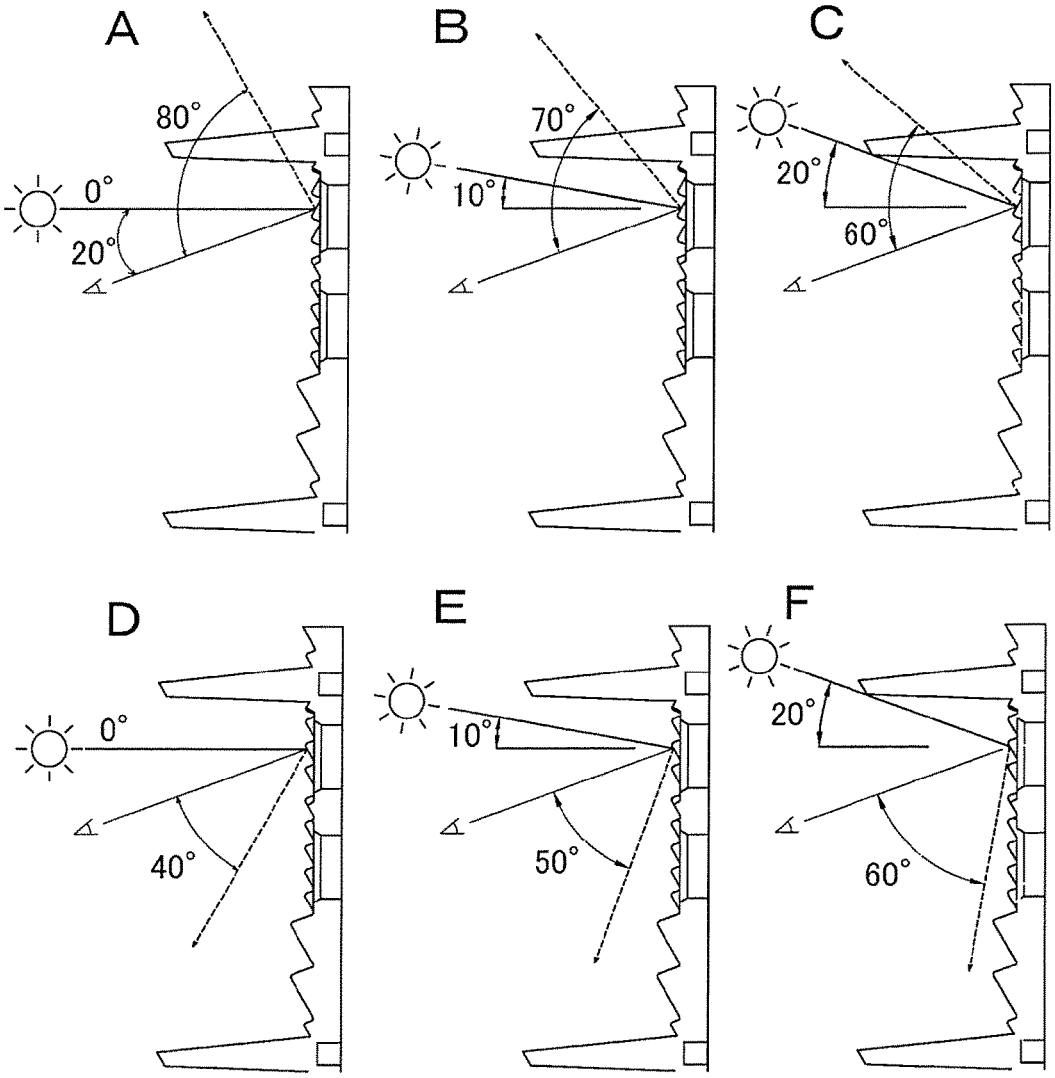
FIG. 3 is a cross-sectional view of a main portion of a display device according to the present invention describing a reflection of incoming light.

As shown in FIGS. 3A to 3C, with the display device 10 of this example constituted as above, when the angle of the line of sigh of the display observer is set to 20° with respect to the perpendicular direction of the display face of the display device 10 (20° is a typical line of sight angle, assuming a common line of sight angle range), incoming light with a relatively small incidence angle of about 30° (and especially about 20°) from a perpendicular to the display face of the display device 10 can be reflected to the upper end canopy 12*a* over a range of 80° to 60°, so it can be seen that an extremely high contrast can be obtained.

Meanwhile, for the sake of comparison, as shown in FIGS. 3D to 3F, a display device that was the same as the display device in the above example was produced, except that the anti-reflective component was not divided into a first anti-reflective component and a second anti-reflective component, and bumps corresponding to the second anti-reflective component were formed. Just as above, when the angle of the line of sight of the display observer was set to 20° with respect to the perpendicular direction of the display face of the display device, incoming light with a relatively small incidence angle of about 30° from a perpendicular to the display face of the display device 10 will only be reflected to the lower end canopy 12*b* near the line of sight of the display observer over a smaller angle range of 40° to 60° than the one mentioned above (60° to 80°), and it can be seen that contrast will be lower than in the above example.

Also, in the example given above, both when the angle of the line of sight of the display observer is less than 20° with respect to the perpendicular direction of the display face of the display device 10, and when it is more than 20°, the angle of the line of sight of the display observer can be made to differ greatly with respect to reflection of incoming light with a relatively small incidence angle. In other words, the light can be reflected at an angle that is away from the line of sight of the display observer. Therefore, it is confirmed that higher contrast can be obtained.

Thus, with the display device of this example, a good viewing angle from below is ensured, while in the display observation direction there will be less reflection of light coming in from a relatively low direction, which is incident from between the horizontal direction and a diagonally upward direction, and this markedly improves contrast.

The present invention can be utilized as a display device for displaying color images by arranging a plurality of light emitting elements in a matrix, and in particular as a color display that gives a vivid image with high contrast even outdoors.

This application claims priority to Japanese Patent Application No. 2007-319622. The entire disclosure of Japanese Patent Application No. 2007-319622 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A display device in which pixels constituted by light emitting elements arranged on a substrate are arranged in a matrix, the substrate comprising:

a surface including an upper portion and a lower portion, the surface substantially being a plane perpendicular to a direction the pixels are facing;

a canopy disposed at least at one of above the upper portion of the surface and below the lower portion of the surface;

a plurality of first anti-reflective components disposed on the upper portion of the surface at a peripheral edge of the light emitting element, each of the first anti-reflective components including:

a first slanted face disposed facing an upward direction at a first angle of inclination ($\Theta_{11}$) respective to the surface, a second slanted face facing a downward direction at a second angle of inclination ($\Theta_{12}$) respective to the surface, and the first angle of inclination ($\Theta_{11}$)being less than the second angle of inclination ($\Theta_{12}$), the first angle of inclination ($\Theta_{11}$) being in a range of $25° \leq \Theta_{11} \leq 45°$, and the second angle of inclination ($\Theta_{12}$) being in a range of $65° \leq \Theta_{12} \leq 85°$;

a plurality of second anti-reflective components disposed on the lower portion of the surface at the peripheral edge of the light emitting element, each of the second anti-reflective components including:

a first slanted face disposed facing an upward direction at a third angle of inclination ($\Theta_{21}$) respective to the surface, a second slanted face facing a downward direction at a fourth angle of inclination ($\Theta_{22}$) respective to the surface, and the third angle of inclination ($\Theta_{21}$) being greater than the fourth angle of inclination ($\Theta_{22}$); and a round track-shaped portion surrounding each light emitting element, the round track-shaped portion being flat and disposed between the each light emitting element and the first anti-reflective components or the second anti-reflective components, at least one of the first anti-reflective components and the second anti-reflective components being disposed between two adjacent ones of the round track-shaped portions that are adjacent to each other along a direction in which the canopy extends.

2. The display device according to claim 1, wherein:

the first angle of inclination ($\Theta_{11}$) of the first slanted faces of the first anti-reflective components is the same as the fourth angle of inclination ($\Theta_{22}$) of the second slanted faces of the second anti-reflective components, and the second angle of inclination ($\Theta_{12}$) of the second slanted faces of the first anti-reflective components is the same as the third angle of inclination ($\Theta_{21}$) of the first slanted faces of the second anti-reflective components.

3. The display device according to claim 1, wherein:

the upper end portion further includes an upper edge, and a first region;

the upper edge disposed along the intersection of the surface and an upper end canopy; and the first anti-reflective components are formed in the first region, the first region extending along a length n from the upper edge such that n satisfies the equation:

$$n=m\cdot\tan\alpha^\circ$$

where m is a height of the upper end canopy, and $\alpha$ is an incidence angle of incoming light that produces reflected light when incident on the display device.

4. The display device according to claim 1, wherein:

the canopy further includes a height extending from the surface to an opposite end of the canopy, in the direction the pixels are facing;

the first anti-reflective components further include a height extending from the surface to where the first slanted face and second face meet, in the direction the pixels are facing;

the second anti-reflective components include a height extending from the surface to where the first slanted face and second face meet, in the direction the pixels are facing; and the substrate further comprises a light blocking component that includes a height that is lower than the height of the canopy, and higher than height of the first anti-reflective components and the height second anti-reflective components, the light blocking component disposed on the lower portion of the surface below the second anti-reflective components.

5. The display device according to claim 1, wherein:

the substrate is subjected to at least one of machining, a process of delustering, or pore formation.

6. The display device according to claim 1, wherein:

the first angle of inclination ($\Theta_{11}$) is different from the fourth angle of inclination ($\Theta_{22}$).

7. A display device in which pixels constituted by light emitting elements arranged on a substrate are arranged in a matrix, the substrate comprising:

a surface including an upper portion and a lower portion, the surface substantially being a plane perpendicular to a direction the pixels are facing;

a canopy disposed at least at one of above the upper portion of the surface and below the lower portion of the surface, the canopy further includes a height extending from the surface to an opposite end of the canopy, in the direction the pixels are facing;

a plurality of first anti-reflective components disposed on the upper portion of the surface at a peripheral edge of the light emitting element, each of the first anti-reflective components including:

a first slanted face disposed facing an upward direction at a first angle of inclination ($\Theta_{11}$) respective to the surface, a second slanted face facing a downward direction at a second angle of inclination ($\Theta_{12}$) respective to the surface, the first angle of inclination ($\Theta_{11}$) being less than the second angle of inclination ($\Theta_{12}$), the first angle of inclination ($\Theta_{11}$) being in a range of $25°\leq\Theta_{11}\leq45°$, and the second angle of inclination ($\Theta_{12}$)) being in a range of $65°\leq\Theta_{12}\leq85°$, and a height extending from the surface to where the first slanted face and second face meet, in the direction the pixels are facing;

a plurality of light blocking components disposed on the lower portion of the surface at the peripheral edge of the light emitting element, each of the light blocking components including:

a first slanted face disposed facing an upward direction at a third angle of inclination ($\Theta_1$) respective to the surface, a second slanted face facing a downward direction at a fourth angle of inclination ($\Theta_2$) respective to the surface, the third angle of inclination ($\Theta_1$) being greater than the fourth angle of inclination ($\Theta_2$), and a height extending from the surface to where the first slanted face and second face meet, in the direction the pixels are facing; and a round track-shaped portion surrounding each light emitting element, the round track-shaped portion being flat and disposed between the each light emitting element and the first anti-reflective components, the first anti-reflective components being disposed between two adjacent ones of the round track-shaped portions that are adjacent to each other along a direction in which the canopy extends, the height of the light blocking components being less than the height of the canopy, and greater than the height of the first anti-reflective components.

8. The display device according to claim 7, wherein:

the upper end portion further includes an upper edge, and a first region;

the upper edge disposed along the intersection of the surface and an upper end canopy; and the first anti-reflective components are formed in the first region, the first region extending along a length n from the upper edge such that n satisfies the equation:

$$n=m\cdot\tan\alpha^\circ$$

where m is a height of the upper end canopy, and $\alpha$ is an incidence angle of incoming light that produces reflected light when incident on the display device.

9. The display device according to claim 7, further including:

a plurality of second anti-reflective components disposed on the lower portion of the surface at the peripheral edge of the light emitting element, each of the second anti-reflective components including:

a first slanted face disposed facing an upward direction at a fifth angle of inclination ($\Theta_{21}$) respective to the surface, a second slanted face facing a downward direction at a sixth angle of inclination ($\Theta_{22}$) respective to the surface, the fifth angle of inclination ($\Theta_{21}$) being greater than the sixth angle of inclination ($\Theta_{22}$), and a height extending from the surface to where the first slanted face and second face meet, in the direction the pixels are facing;

the height being less than the height of the light blocking components.

10. The display device according to claim 9, wherein:

the first angle of inclination ($\Theta_{11}$) is different from the sixth angle of inclination ($\Theta_{22}$).

11. The display device according to claim 9, wherein:

the first angle of inclination ($\Theta_{11}$) of the first slanted faces of the first anti-reflective components is the same as the sixth angle of inclination ($\Theta_{22}$) of the second slanted faces of the second anti-reflective components, and the second angle of inclination ($\Theta_{12}$) of the second slanted faces of the first anti-reflective components is the same as the fifth angle of inclination ($\Theta_{21}$) of the first slanted faces of the second anti-reflective components.

12. The display device according to claim 7, wherein:

the substrate is subjected to at least one of machining, a process of delustering, or pore formation.

13. A display device in which pixels constituted by light emitting elements arranged on a substrate are arranged in a matrix, the substrate comprising:

a surface including an upper portion and a lower portion, the surface substantially being a plane perpendicular to a direction the pixels are facing;

a canopy disposed at least at one of above the upper portion of the surface and below the lower portion of the surface;

a plurality of first anti-reflective components disposed on the upper portion of the surface at a peripheral edge of the light emitting element, each of the first anti-reflective components including:

a first slanted face disposed facing an upward direction at a first angle of inclination ($\Theta_{11}$) respective to the surface, a second slanted face facing a downward direction at a second angle of inclination ($\Theta_{12}$) respective to the surface, the first angle of inclination ($\Theta_{11}$) being less than the second angle of inclination ($\Theta_{12}$), the first angle of inclination ($\Theta_{11}$) being in a range of $25° \leq \Theta_{11} \leq 45°$, and the second angle of inclination (($\Theta_{12}$)) being in a range of $65° \leq \Theta_{12} \leq 85°$, and the angle at which the first slanted face and the second slanted face meet is obtuse;

a plurality of second anti-reflective components disposed on the lower portion of the surface at the peripheral edge of the light emitting element, each of the second anti-reflective components including:

a first slanted face disposed facing an upward direction at a third angle of inclination ($\Theta_{21}$) respective to the surface, a second slanted face facing a downward direction at a fourth angle of inclination ($\Theta_{22}$) respective to the surface, the third angle of inclination ($\Theta_{21}$) being greater than the fourth angle of inclination ($\Theta_{22}$), and and the angle at which the first slanted face and the second slanted face meet is obtuse; and a round track-shaped portion surrounding each light emitting element, the round track-shaped portion being flat and disposed between the each light emitting element and the first anti-reflective components or the second anti-reflective components, at least one of the first anti-reflective components and the second anti-reflective components being disposed between two adjacent ones of the round track-shaped portions that are adjacent to each other along a direction in which the canopy extends.

14. The display device according to claim 13, wherein:

the first angle of inclination ($\Theta_{11}$) of the first slanted faces of the first anti-reflective components is the same as the fourth angle of inclination ($\Theta_{22}$) of the second slanted faces of the second anti-reflective components, and the second angle of inclination ($\Theta_{12}$) of the second slanted faces of the first anti-reflective components is the same as the third angle of inclination ($\Theta_{21}$) of the first slanted faces of the second anti-reflective components.

15. The display device according to claim 13, wherein:

the upper end portion further includes an upper edge, and a first region;

the upper edge disposed along the intersection of the surface and an upper end canopy; and the first anti-reflective components are formed in the first region, the first region extending along a length n from the upper edge such that n satisfies the equation:

$$n = m \cdot \tan \alpha°$$

where m is a height of the upper end canopy, and $\alpha$ is an incidence angle of incoming light that produces reflected light when incident on the display device.

16. The display device according to claim 13, wherein:

the substrate is subjected to at least one of machining, a process of delustering, or pore formation.

17. The display device according to claim 1, wherein:

the first angle of inclination ($\Theta_{11}$), is different from the fourth angle of inclination ($\Theta_{22}$).

18. The display device according to claim 1, wherein:

the round track-shaped portion includes a generally flat surface that surrounds an entire periphery of each light emitting element.

19. The display device according to claim 7, wherein:

the round track-shaped portion includes a generally flat surface that surrounds an entire periphery of each light emitting element.

20. The display device according to claim 13, wherein:

the round track-shaped portion includes a generally flat surface that surrounds an entire periphery of each light emitting element.

21. The display device according to claim 1, wherein:

the third angle of inclination ($\Theta_{21}$) being in a range of $65° \leq \Theta_{21} \leq 85°$, and the fourth angle of inclination ($\Theta_{22}$) being in a range of $25° \leq \Theta_{22} \leq 45°$.

22. The display device according to claim 9, wherein:

the fifth angle of inclination ($\Theta_{21}$) being in a range of $65° \leq \Theta_{21} \leq 85°$, and the sixth angle of inclination ($\Theta_{22}$) being in a range of $25° \leq \Theta_{22} \leq 45°$.

23. The display device according to claim 13, wherein:

the third angle of inclination ($\Theta_{21}$) being in a range of $65° \leq \Theta_{21} \leq 85°$, and the fourth angle of inclination ($\Theta_{22}$) being in a range of $25° \leq \Theta_{22} \leq 45°$.

* * * * *